United States Patent [19]

Cloup

[11] 4,040,217

[45] Aug. 9, 1977

[54] APPARATUS FOR ERECTING A MAST

[76] Inventor: Jean Cloup, Latresne, France

[21] Appl. No.: 633,262

[22] Filed: Nov. 19, 1975

Related U.S. Application Data

[63] Continuation of Ser. No. 441,347, Feb. 11, 1974, abandoned.

[30] Foreign Application Priority Data

Feb. 22, 1973 France ..... 73.06354

[51] Int. Cl.[2] ..... E04H 12/18; E04H 12/34

[52] U.S. Cl. ..... 52/115; 52/632

[58] Field of Search ..... 52/632, 110–118, 52/745

[56] References Cited

U.S. PATENT DOCUMENTS

| | | | |
|---|---|---|---|
| 401,623 | 4/1889 | Albert | 52/114 |
| 3,150,740 | 9/1964 | Rubeli | 52/111 |
| 3,185,265 | 5/1965 | White | 52/111 |

FOREIGN PATENT DOCUMENTS

| | | | |
|---|---|---|---|
| 608,777 | 11/1960 | Canada | 52/111 |
| 201,042 | 1/1966 | Sweden | 52/111 |
| 465,086 | 4/1937 | United Kingdom | 52/111 |

*Primary Examiner*—Price C. Faw, Jr.
*Assistant Examiner*—James L. Ridgill, Jr.
*Attorney, Agent, or Firm*—Stevens, Davis, Miller & Mosher

[57] ABSTRACT

This invention relates to a method of and apparatus for erecting a vertical mast.

In the invention a mast balanced by tensioned guys is erected while maintaining the guys in their tensioned condition.

9 Claims, 7 Drawing Figures

20b
21b
22b
22a
17
18
19
20a
21a

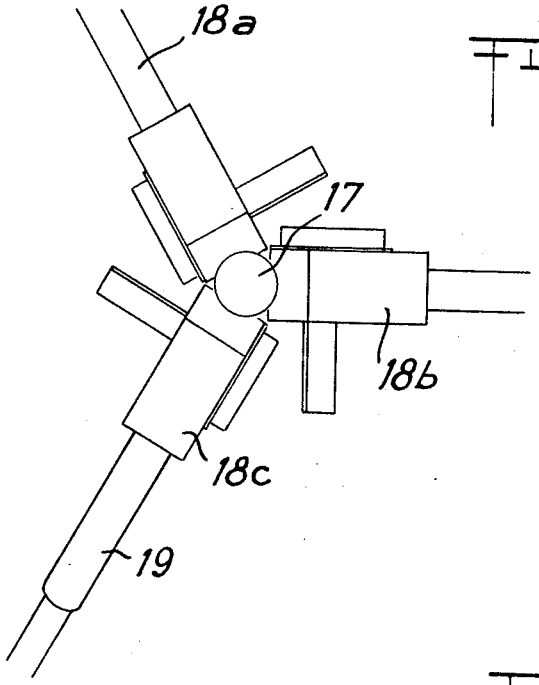
FIG. 3
FIG. 6
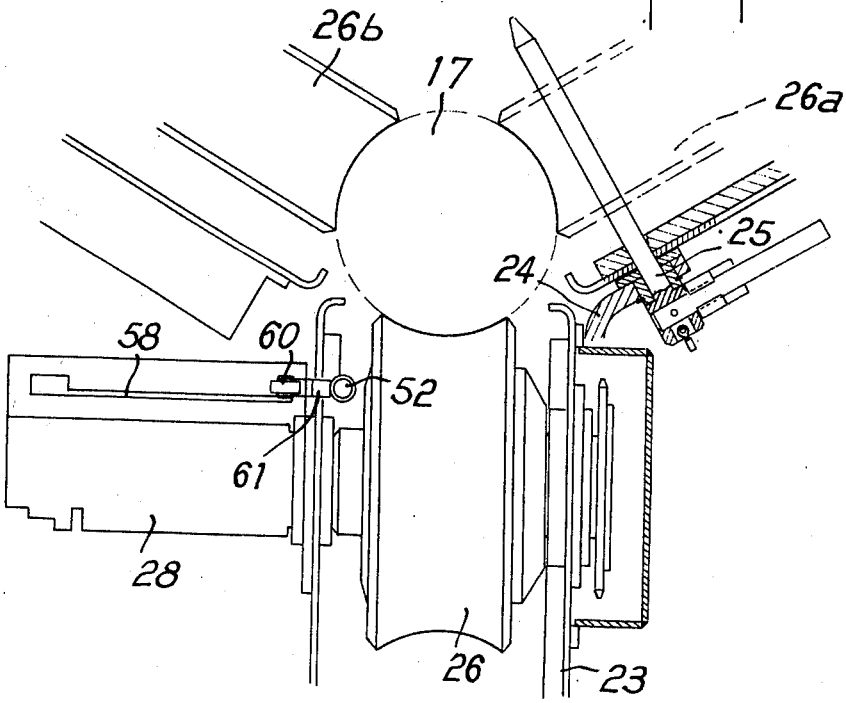

APPARATUS FOR ERECTING A MAST

This application is a continuation of application 441,347 filed Feb. 11, 1974, now abandoned.

This invention relates to a method of and apparatus for erecting a vertical mast supported by guy ropes.

Devices are known which make it possible to erect, in the vertical position, a mast which is made up of elements which fit together and which is raised by means of guide and drive rollers in contact with the wall of the mast, the latter being supported by guys passing over countershaft pulleys fixed to the ground. The guys are unwound from winches, the unwinding of which is synchronized with the drive of the friction rollers. However, such a device requires a perfectly flat area of ground and this is a disadvantage because it is often difficult to come across such a condition.

According to one aspect of the present invention there is provided a method of erecting a vertical mast supported by guy ropes fixed to the upper part of the mast and which pass over pulleys fixed to the ground, the method comprising balancing the mast by the tension of the guy ropes and during erection of the mast maintaining the guy ropes in their tensioned condition and altering the length of the guy ropes between the upper part of the mast and the pulleys.

According to another aspect of the present invention there is provided apparatus for erecting a vertical mast, such apparatus comprising guy ropes for attachment to the upper part of the mast, pulleys for fixing to the ground over which the guy ropes are adapted to pass so that the mast can be balanced by the tension of the guy ropes, means for maintaining the guy ropes in their tensioned condition during erection of the mast and altering the length of the guy ropes between the upper part of the mast and the pulleys.

Illustrative embodiments of the present invention will now be described with reference to the accompanying drawings, in which:

FIG. 3 is a plan view showing the erection device of FIG. 2;

Figures 5, 5A:
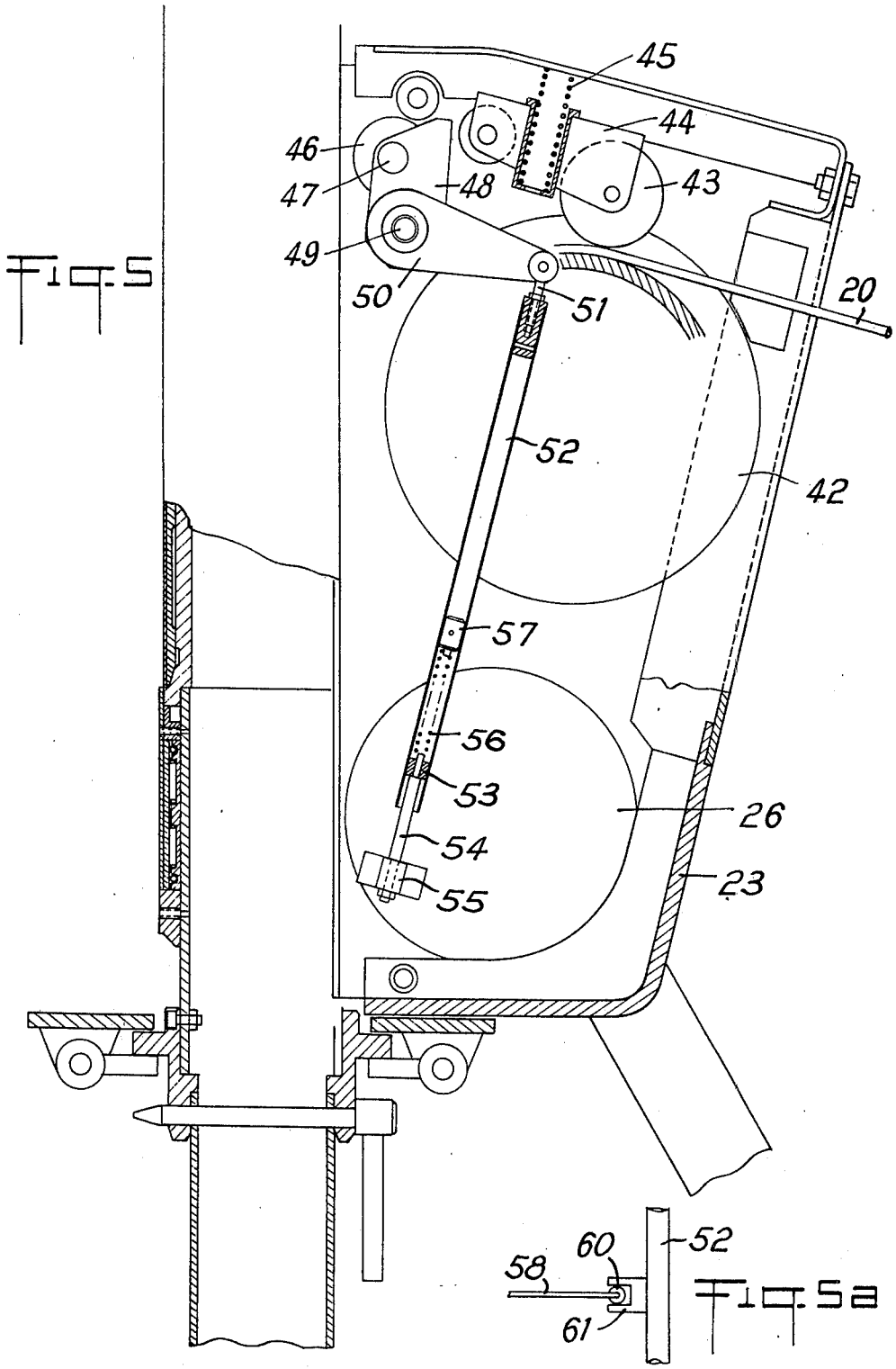
FIG. 5 is a side view of the driving mechanism represented in FIG. 4.

FIG. 5*a* is a detail view of the device which controls the direction of rotation of the motor;

FIG. 6 is a plan view of the friction rollers.

Figure 1:
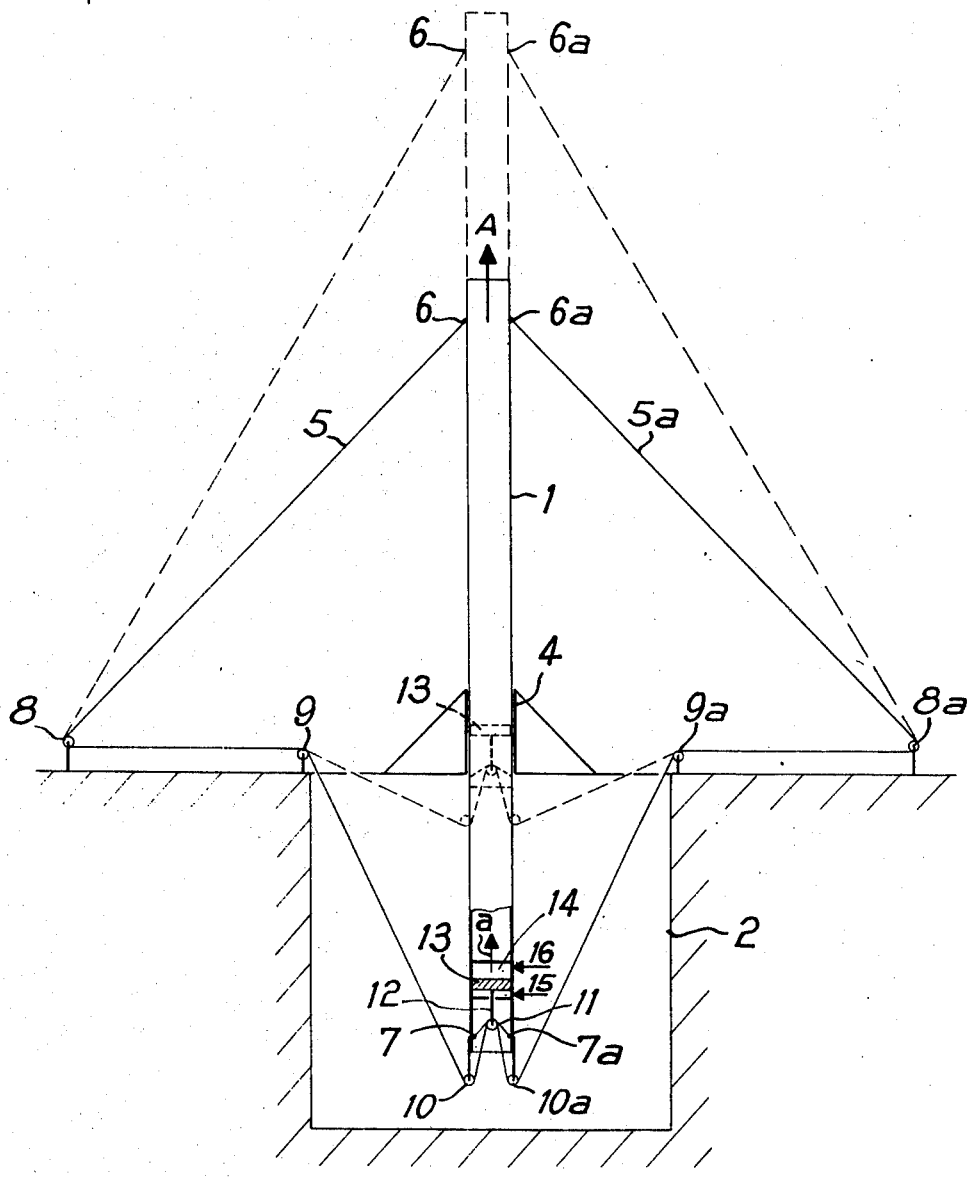
FIG. 1 is a diagrammatic view in elevation of a device for erecting a mast.

FIG. 1 illustrates diagrammatically a mast 1 which is inserted into a pit 2 erected above the level of the ground 3 in order to be used, for example as an antenna support.

In FIG. 1 the mast 1, which is guided by a tubular member 4 placed above the pit 2, is supported by a plurality of guys 5, 5*a* etc., for instance, three, spaced apart at 120° intervals, (in the FIG. 1 only two are shown).

The guys 5, 5*a* etc. are fixed on at 6, 6*a* to the upper part of the mast 1 and also at 7, 7*a* to the lower part of the mast.

The guys 5, 5*a* are guided by pulleys 8, 8*a* and 9, 9*a* fixed to the ground and by pulleys 10, 10*a* firmly fixed to the base of the mast. Furthermore, the guys 5, 5*a* pass over a pair of pulleys 11 firmly fixed to a rod 12 of a piston 13 of a double-acting jack, the barrel 14 of which is firmly fixed to the mast 1 and which can be supplied with actuating fluid in a known manner, at both ends thereof via pipelines 15 and 16.

When the mast 1 is in any position and when no traction is exerted on the guys 5, 5*a*, the weight of the latter is balanced by the tension of the guys.

On the other hand, if fluid is injected at 15 into the barrel 14 of the jack, the piston 13 travels in the direction of the arrow *a*, thus causing a reduction in the length of the guys 5, 5*a* between the pulley 10 and the points 6 and exerting a tension on the guys which is greater than the weight of the mast 1 so that the latter is raised in the direction of the arrow as shown by the dotted outline of the mast and guys in FIG. 1.

When the piston 13 is acted on in the direction opposite to the arrow a by fluid injected through the pipeline 16, this results in an increase in the length of the guys between the pulley 10 and the points 6 and a decrease in the tension on the guys, to cause the mast to descend into the pit 2 in the direction opposite to the arrow A.

Figure 2:
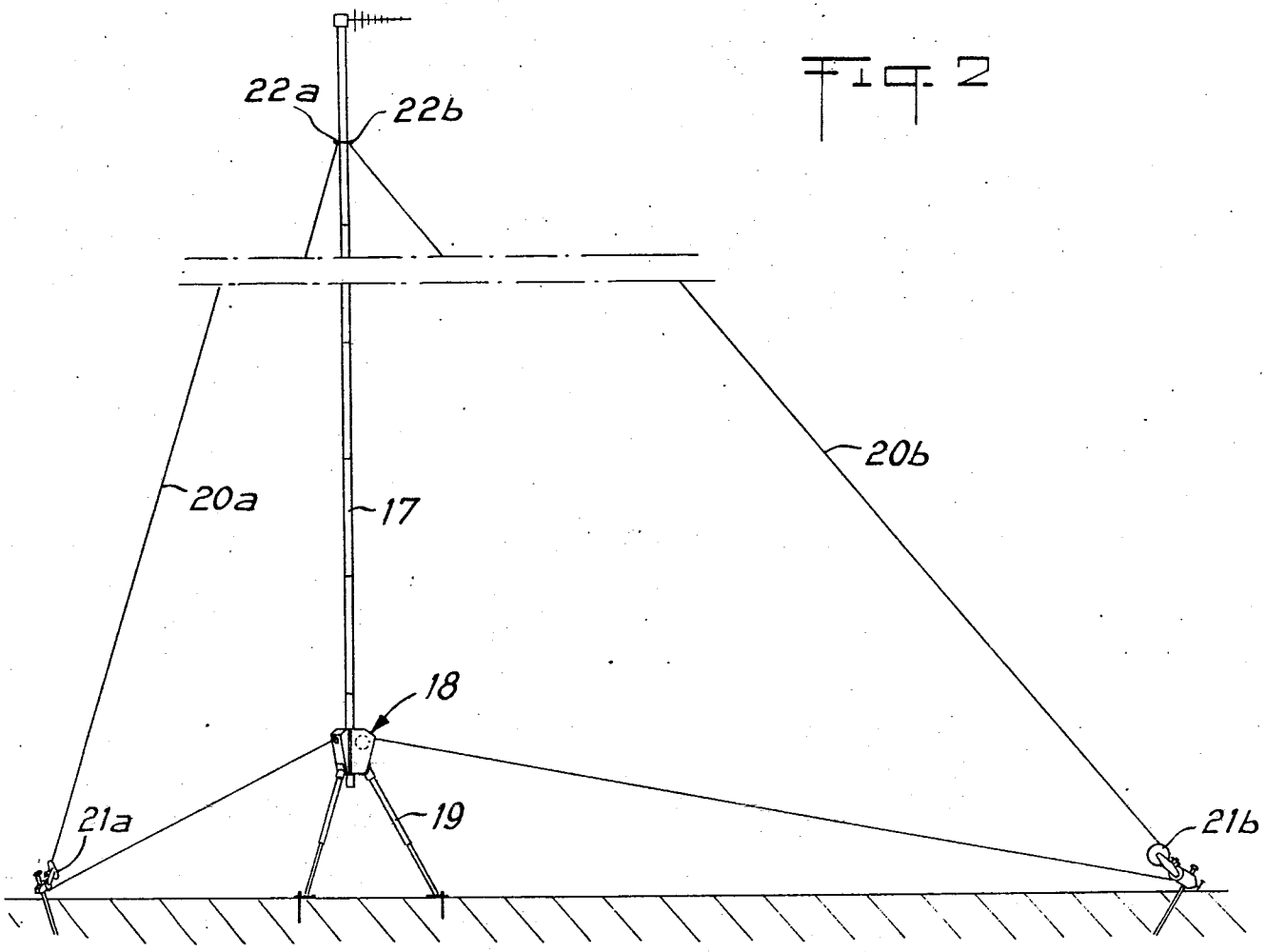
FIG. 2 is a view in elevation of another embodiment of the device for erecting a mast.

FIG. 2 illustrates a further embodiment of the device for erecting a mast 17 from a plurality of parts which are assembled at the base of the device as the mast is being erected.

An erection device 18 which rests on tripod 19 comprises three parts 18*a*, 18*b* and 18*c* (See FIG. 3) spaced apart by 120°. Each part 18 is associated with a guy, two of which 20*a*, 20*b* are shown. The guys are wound up on pulleys for instance, pulleys 21*a*, 21*b* fixed to the ground and are fixed at 22*a*, 22*b* to the upper part of the mast 17.

The parts 18*a*, 18*b*, 18*c* which comprise as casing 23, are connected to one another by brackets 24 fixed by pegs 25.

Inside the casings 23, friction rollers 26, 26*a*, 26*b* spaced apart by 120°, are mounted for rotation and so that they are in contact with the wall of the mast 17 as shown in FIG. 6.

Each roller 26 is mounted in a roller-bearing 27, 27*a* and it is driven by a hydraulic motor 28 supplied in a known manner by a pump which is not shown in the drawings.

The hydraulic motor 28 includes a shaft 29 to which there is keyed a sun gearwheel 30 which meshed planet gearwheels 31 mounted to rotate on a support 32 firmly fixed to an output shaft 33.

The planet gearwheels 31 also mesh with a sprocket wheel 34 firmly fixed to the friction roller 26.

On the output shaft 33 of the reduction device there is keyed on a cogwheel 35 which is connected via a chain 37 to a cogwheel 36 keyed, at 40, to the end of shaft 38 mounted for rotation in roller-bearings 39, 39*a* arranged in the casing 23.

Figure 4:
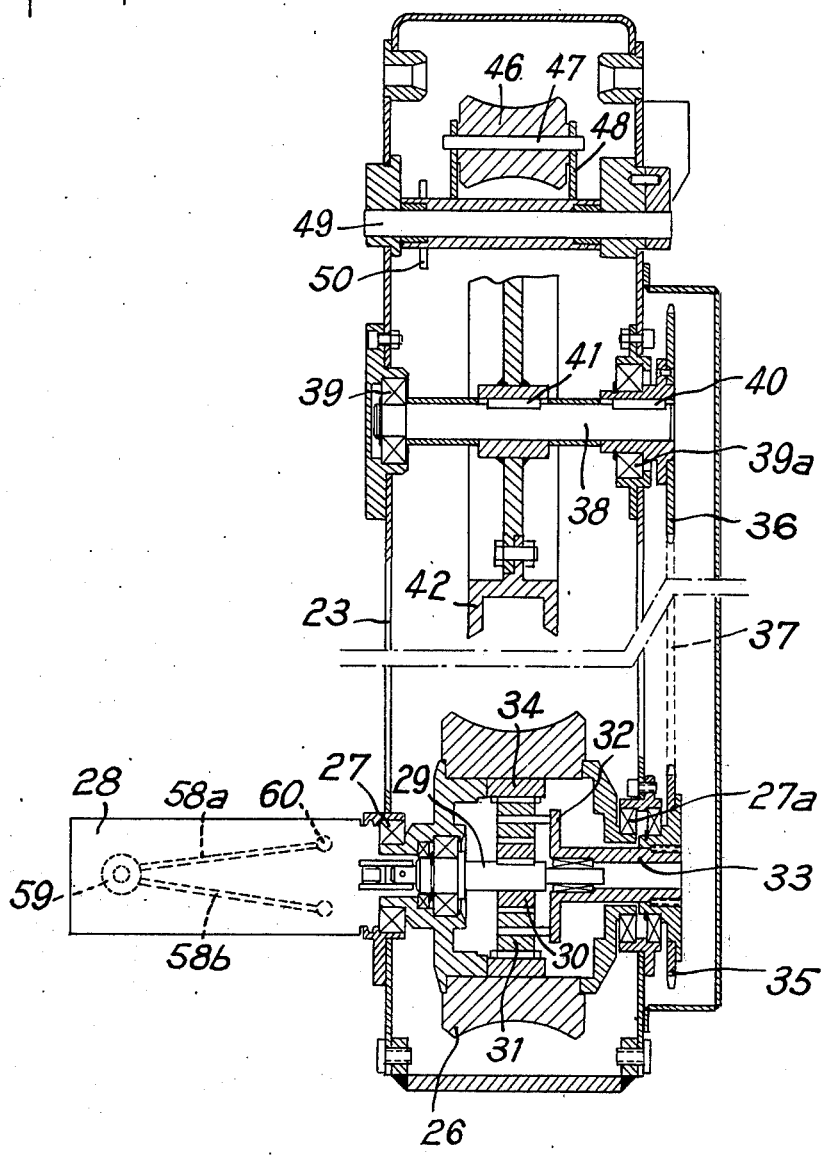
FIG. 4 is a view in longitudinal cross-section of one of the driving mechanisms of a friction roller and of a guy pulley.

On the shaft 38 there is keyed, at 41, a pulley 42 on which a guy 20 is wound up (FIGS. 2, 4 and 5), the guy being guided by a roller 43 mounted on a support 44 fixed on the casing 23 and subjected to the action of a spring 45.

A probe is mounted above each friction roller 26, this probe consisting of a roller 46 (FIGS. 4, 5 and 6) mounted to rotate about a shaft 47 fixed to cover 48, mounted to pivot about shaft 49 firmly fixed to the casing 23.

The cover 48 is equipped with a lever 50 carrying at its end a hinge 51 which is connected to a hollow rod 52 guided at its other end by a slide-block 53 firmly fixed to rod 54 which is connected by a boss 55 to the casing 23.

Inside the hollow rod 52 there is provided a spring 56 which rests on the one hand against the slide-block 53 and on the other hand against a stop fixed inside the hollow rod.

In this way, the probe, the roller of which travels angularly about the shaft 49, transmits to the rod 52 linear movement which makes it possible to adjust the position of a lever 58 which controls the direction of rotation off the hydraulic motor 28. This lever 58, which is hinged about a shaft 59, is provided at its end with a roller 60 which is inserted into a U-shaped member 61 (FIGS. 5, 5*a* and 6) firmly fixed to the hollow rod 52 which thus transmits movements of the probe or roller 46 to control lever 58 which can occupy two position 58*a,* 58*b* corresponding to the two directions of rotation of the motor 28.

The roller 46 and the lever 50 form part of a sensor for detecting the relative inclination of the mast for controlling the motor 28 to control rotation of the friction roller 26 in response to the relative inclination of the mast so that it is kept substantially vertical as it is raised.

By comparing the embodiment of the device fo FIG. 1 and that of FIGS. 2 to 6, which has been described above, it is seen that the lower part of the cable has been replaced by the friction roller 26 which is connected via a differential device or planetary reduction device 31, 32, 33, 34 to the pulley 42 on which the guy for balancing the weight of the mast is wound up.

The shortening of the guys 20*a,* 20*b,* 20*c* is achieved by varying the relative position of the friction roller 26 and the pulley 42 by means of a planetary reduction device 30, 31, 32, 34 with a very high ratio, the input torque of which is very low relative to the torque created by the guy 20*a,* 20*b,* 20*c* and by the mast 17.

The length of each guy 20*a,* 20*b,* 20*c* determined by the rotation of the hydraulic motor 28 and it is advantageous to distribute the input energy to each of the three guys by having it controlled by the uprightness of the mast 17. This uprightness is checked by the probes in such a way that when the mast 17 is leaning to one side, it comes into contact with the corresponding roller 46 and causes the latter to pivot about the axle 49, together with the lever 50 which acts on the rod 52.

As it travels linearly in opposition to the spring 56, the rod 52 drives the U-shaped component 61 which acts on the roller 60 and causes the lever 58 to pivot about its axle 59, so as to bring the said lever from the position 58*a* to the position 58*b* or vice versa in order to slow down and then to reverse the direction of rotation of the motor and to increase or decrease the length of the corresponding guy.

Of course, various modifications can be introduced by those skilled in the art to the devices or processes which have just been described soley by way of non-limiting examples, without going outside the scope of the invention.

I claim:

1. An apparatus for raising a vertical mast having an upper portion and a base, said apparatus comprising:

guy lines attached to the upper portion of said mast points of attachment thereon for balancing said mast, pulleys fixed to the earth for securing the guy lines to balance the mast, first means operatively connected to said guy lines for increasing the tension in said guy lines, second means operatively connected to the base of the mast for applying an upwardly directed force to the base of the mast derived from the tension in the lines that is capable of overcoming the weight of the mast and the downwardly directed force on the mast created by said tension at said points of attachment, said mast being raised upon the increase of tension in the lines by said tension increasing means so that said second means creates an upwardly directed force on said base that overcomes the weight of the mast and the downwardly directed force on said mast at said points of attachment due to said tension in said lines.

2. The apparatus of claim 1 wherein said second means comprises pulleys attached to the base of the mast of securing said guy lines and means for affixing ends of said lines to the base of the mast and said first means comprises a hydraulic piston and cylinder assembly having a pulley displaceable with said piston over which the lines are passed so that by the addition of fluid to said cylinder said piston transmits a force to said displaceable pulley so that the tension in said lines is varied.

3. Apparatus for raising a vertical mast having an upper portion and a base comprising guy lines attached to the upper portion of the mast for balancing it, pulleys fixed to the earth over which the guy lines are passed to balance the mast, a plurality of friction rollers engageable with said mast near the base thereof for applying a force to said base sufficient to overcome the weight of the mast and the downwardly directed force due to the tension in said lines at said points of attachment, a plurality of motive power means each being operatively connected to one of said friction rollers and capable of turning said rollers in two directions, and sensing means engageable by the mast for detecting the relative inclination of the mast for controlling each of said motive power means to control the rotation of said friction rollers in response to the relative inclination of said mast so that the mast may be kept substantially vertical as it is raised.

4. Apparatus according to claim 3, in which the motive power means comprises a hydraulic motor.

5. Apparatus according to claim 3, wherein said sensing means associated with each friction roller for detecting relative inclination of the mast includes transmission and control means connected for controlling operation of the motor power means in dependence on the relative inclination of the mast detected by the sensing means.

6. Apparatus according to claim 5, in which each sensing means includes a further roller adapted to engage the mast, a pivotal lever on which the further roller is rotatably mounted, the lever being connected to the transmission and control means to allow the torque and direction of rotation of the motive power means to be adjusted.

7. The apparatus of claim 3 further including windup rollers each being operatively connected with one of said friction rollers for winding up slack and maintaining tension in each of said lines as said friction rollers are rotated.

8. The apparatus of claim 7 including reduction gearing coupling said motive power means to said friction roller and said windup roller.

9. Apparatus according to claim 8, in which the reduction gearing includes a sun gear drivingly connected to the friction roller and a planet gear for driving the windup roller.

* * * * *